United States Patent [19]

Buehler

[11] Patent Number: 4,824,033

[45] Date of Patent: Apr. 25, 1989

[54] GAP-TYPE BALL MILL FOR CONTINUOUS PULVERIZATION, PARTICULARLY BREAKDOWN OF MICROORGANISMS, AND DISPERSION OF SOLIDS IN A LIQUID

[75] Inventor: Gerhard Buehler, Rheinfelden, Fed. Rep. of Germany

[73] Assignee: FRYMA-Maschinenbau GmbH, Rheinfelden, Fed. Rep. of Germany

[21] Appl. No.: 189,801

[22] Filed: May 3, 1988

[30] Foreign Application Priority Data

May 15, 1987 [DE] Fed. Rep. of Germany ..... 3716295

[51] Int. Cl.[4] ..... B02C 17/16

[52] U.S. Cl. ..... 241/66; 241/172

[58] Field of Search ..... 241/171, 172, 46.17, 241/65, 66, 67, 44

[56] References Cited

U.S. PATENT DOCUMENTS

| | | | |
|---|---|---|---|
| 2,042,254 | 5/1936 | Godinez | 241/44 |
| 3,307,792 | 3/1987 | Hughes et al. . | |
| 3,511,447 | 5/1970 | Brizon | 241/172 |

FOREIGN PATENT DOCUMENTS

| | | | |
|---|---|---|---|
| 1183344 | 12/1964 | Fed. Rep. of Germany | 241/172 |
| 2034238 | 7/1970 | Fed. Rep. of Germany . | |
| 3245825 | 12/1982 | Fed. Rep. of Germany . | |
| 3526724 | 1/1987 | Fed. Rep. of Germany | 241/172 |
| 792310 | 12/1935 | France | 241/172 |
| 639567 | 3/1979 | Switzerland . | |
| 1255203 | 9/1986 | U.S.S.R. | 241/172 |

*Primary Examiner*—Mark Rosenbaum

*Attorney, Agent, or Firm*—Holman & Stern

[57] ABSTRACT

Three mill units are mounted axially in series in a mill housing with a cover. Each mill unit has a rotor disc between two stator discs. The rotor discs are secured to the rotor shaft at their radially interior region. The stator discs are secured to the housing wall at their radially outer region. Individual pulverization gaps are formed between the stator discs, which gaps run around the rotor discs and in longitudinal cross section extend sequentially with a serpentine shape. The outer parts of the pulverization gaps form individual gap loops the inner ends of which are connected or "short-circuited" via ball return channels. During operation, the grinding elements are accelerated outward by centrifugal forces, and are concentrated into the gap loops. The grinding elements in each of the individual stages may be kept separated from the grinding elements in other stages; and they may have different sizes from stage to stage. The individual mill stages can be replaced as units. Alternatively, the rotor discs and stator discs which are rotationally symmetric can be replaced individually. They can have different axial cross sections, containing a single bend or multiple bends. The processing pressure for the material being pulverized which is passed through the serpentine pulverization gap system can be set accurately based on the rotational speed (rpm), so that microorganisms are recovered without the hyaloplasm leaking out or being worked into (i.e. intermixing with or being forced into intercalation with) the other materials.

24 Claims, 2 Drawing Sheets

GAP-TYPE BALL MILL FOR CONTINUOUS PULVERIZATION, PARTICULARLY BREAKDOWN OF MICROORGANISMS, AND DISPERSION OF SOLIDS IN A LIQUID

BACKGROUND OF THE INVENTION

1. Field of the Invention

The invention relates to ball mills. Specifically, the invention relates to ball mills for continuously pulverizing materials including microorganisms and dispersion solids.

2. Description of the Background Art

Ball mills of the subject type are known in various embodiments. The term "ball" refers not only to the preferred true spherical grinding elements but also to any other grinding elements which are suitable for producing pulverization of solid particles of a material undergoing grinding, by means of mutual compressive rolling, and compressive rolling at the boundary surfaces of the milling or pulverization space.

As a rule, the spheres used are finely ground or of small diameter and are comprised of hard wear-resistant steel, hard metal, glass, or ceramic. However, grinding elements comprised of other materials can be employed. In the past, grains of sand were used as a primary or secondary grinding element. Often the only way these could be converted to a form suitable for use as an aid in compressive rolling was by a pregrinding process.

Swiss Pat. No. 639,567 discloses a gap-type ball mill intended for continuous operation, wherein an impeller member of the rotor, having a wedge-shaped cross section, surrounds the mill axis at a radial distance therefrom, and fits operatively into a pulverization space of like shape in the stator. The material being pulverized flows over the entire impeller which is mounted on a rotor disc in an extended acceleration phase, and around the tip of the wedge, and then is passed inwardly to the extend of about half the radius, to an exit structure.

The grinding elements flow generally in the same path as the material being pulverized, but they are separated out by a separating device before they exit and are passed through a ball return channel running outward at an angle in the rotor disc. Moving thus outward by centrifugal force, they are returned to the region where the material being pulverized is admitted or the "inlet region". From there they are recirculated through their closed circulation path.

In this way, high energy-densities are concentrated onto a small surface and in a small space, thereby enabling high pulverizing output in a compact mill, combined with low manufacturing cost. However, it is a challenge to provide a configuration of the separating device and ball return system which does not lead to jamming of the balls. The consequences of jamming are aggravated by the fact that the cooperating parts such as the rotor and stator all have unitary structures which can only be repaired and replaced as a unit.

There are other known embodiments, particularly in connection with the ring-type gap mills, wherein parts active in the pulverization are replaceable. Such an example is German Pat. No. 3,526,724. However, particularly with high speed mills, this leads to problems in the repair process with regard to the mounting means for the replaceable mill elements. On the other hand, the principle is promising in that it enables the combination of successive milling stages or even disparate milling processes. Another advantage is that rotor and stator discs with axial passages or openings through them are provided. Nonetheless, at high material throughputs, all the grinding elements being circulated must be intercepted by a single interstage separating device, which can readily lead to jamming of the large number of said grinding elements, thereby disabling the mill.

The present invention is a gap-type ball mill as described above. The underlying problem to be solved by the invention is to refine the gap-type ball mill in the simplest manner possible, particularly for purposes of breaking down microorganisms, such that the mill can be used for a variety of tasks without the danger and disadvantage of jamming of the balls, and can be easily maintained and repaired, so that downtime is low.

SUMMARY OF THE INVENTION

A gap-type ball mill for continuous fine pulverization according to the invention, which is particularly desirable for breaking down microorganisms and dispersing solids in liquids, has the following features:

(a) Stator discs are mounted in the mill housing in such a way as to be easily replaceable. They are fixed at their outer edges.

(b) The stator discs are associated and matched, at least in pairs and possible in larger numbers so as to form together a stator "unit" which extends generally, radially and includes a rotationally symmetrical pulverization space "unit".

(c) A mill shaft, connected to a rotary drive, extends centrally through the stator unit, and is at least indirectly rotationally-mounted at one end in the mill housing.

(d) The mill shaft bears at least one easily replaceable rotor disc, which with two stator discs forms rotationally symmetric pulverization gap in the pulverization space unit.

(e) The rotor disc extends generally, radially outward from the mill axis, and in axial cross section forms a gap loop which is closed to the exterior.

(f) The said gap loop is short-circuited preferably by at least two ball return channels which extend radially outward from the mill axis and serve as centrifugal guiding structures.

BRIEF DESCRIPTION OF THE DRAWINGS

The drawings illustrate a preferred, exemplary embodiment of the invention.

DETAILED DESCRIPTION OF THE INVENTION

Figure 1:
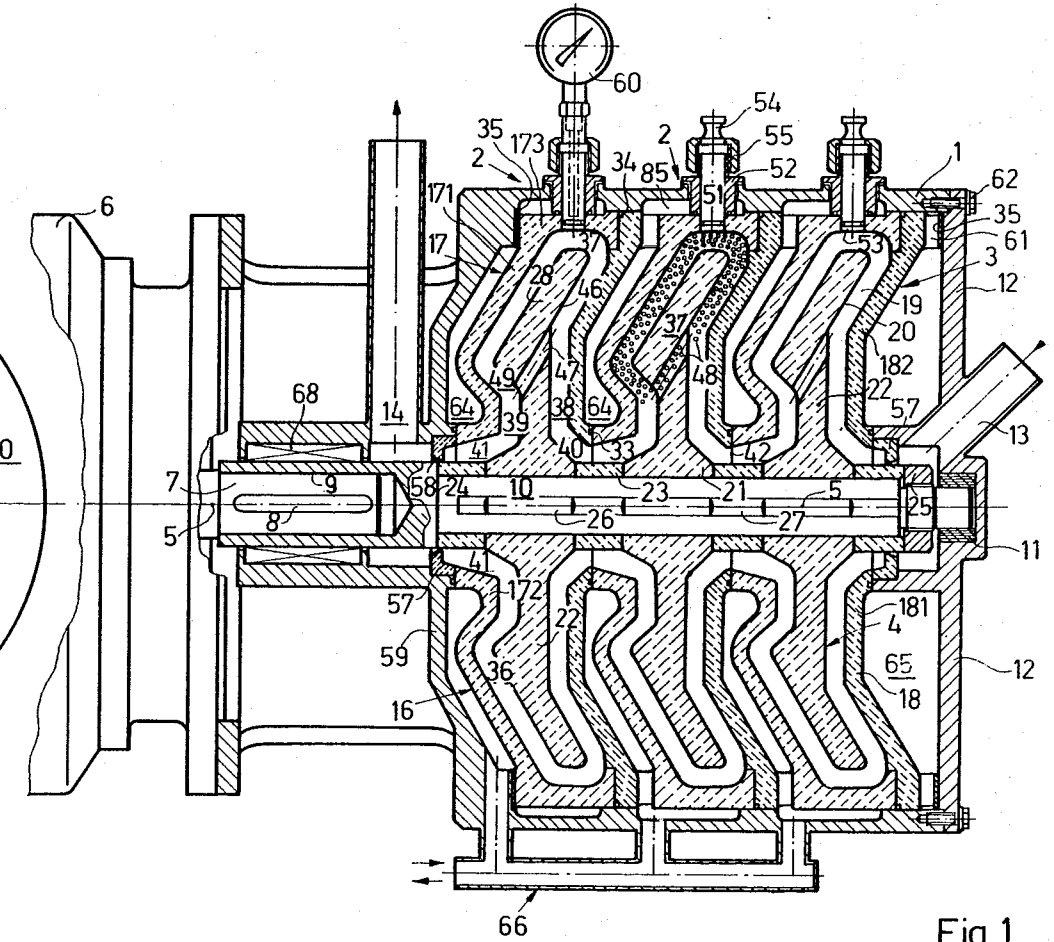
FIG. 1 is a longitudinal cross section through an inventive gap-type ball mill.

All the essential parts of the invention for pulverization are very easily replaceable, particularly the stator discs and the rotor discs. Not only does this reduce the time lost due to repairs, but also it enables rational use of special materials according to locally occurring conditions, which has proved economical despite the use of costly materials at specific locations which can be in the form of thin surface layers. Importantly, a ball recirculation region is provided in the middle part of the mill unit, and thereby keeps the mill balls a distance away from the outlet of the unit. Again, a type of separating device in the form of a frictionally sealed gap 57 and 58 or the like is provided, but with the inventive structure it is not possible for a large aggregation of grinding elements to form immediately ahead of such a separating device and they, thereby, become jammed in the mill.

The provision of separate, interchangeable component parts, some of which are identical, and which can be replaced individually or in groups within a mill unit has the additional advantage that essentially any desired number of mill units may be combined in series, without modifications other than a change in the mill housing and drive shaft. The housing and shaft can also be comprised of unit elements to allow incremental expansion or contraction. Also, in principle, a large housing can be employed in which one or more mill units are operated, each of which has its own closed grinding element loop. The individual mill stages or units can thus be provided with grinding elements of differing sizes or for example, the first mill unit is operated with large grinding elements, the second with the next smaller size of grinding elements, and so forth. This enables a progressive increase in the intensity and uniformity of the pulverization process; and an energy density which is increased at least on the average, and consequently higher production with reduced mill volumes.

The appropriate provision of different flow paths of grinding elements and material being pulverized, permits appropriately different and differently directed forces to act at the separation point. The separation point is where grinding elements are separated from the material being pulverized. The grinding elements are separated out chiefly by corresponding high centrifugal forces, and the angle of deflection is so great that the material being pulverized, affected by inertia and by pressure gradients, flows further on the prescribed path. However, it is better if the grinding elements of the individual mill units are separated out by mechanical separating devices such as frictionally sealed gaps.

The inventive structure is relatively simple, because it is comprised principally of stator discs and rotor discs having the shapes of figures of rotation. These are economically manufacturable by customary methods. The inventive configuration enables relatively long flow paths to be provided in a very small space, thereby enabling relatively high processing times.

In addition, the rotor discs can be given a relatively large cross section with corresponding thickness, whereby the resistance to breakage of the disc structures is high, even with discs comprised of materials which can be damaged upon the suffering of bending or tensile stress, e.g., ceramics.

The inventive gap-type ball mill is especially suited for breakdown of microorganisms, which has become an important process in bioengineering. The microbes of interest are comprised of capsule-like cells with a cell fluid or hyaloplasm containing a material which is sough to be recovered to the maximum extent possible. For mechanical recovery, it has been proposed to use wet grinding in stirred ball mills. The yield of such a process is limited, however. The proportion of the desired material recovered is determined by the pressure employed in the grinding process. This is because of the rubberlike elasticity of the cell walls. If the pressure is insufficient, the cell will remain intact under elastic deformation. If the pressure is excessive, the cell wall hyaloplasm, and desired material can often become so strongly intermixed that it is difficult to subsequently separate them. With the inventive gap-type ball mill, however, the pressure to be applied is essentially determined in advance, and can be adjusted to achieve optimal conditions for cell breakdown and desired material recovery.

An important consideration in bioengineering is the possibility of thoroughly sterilizing the surfaces which come into contact with the material being pulverized. According to the invention, smooth surfaces are employed. In most cases, these surfaces have no sharp-edged parts, sharp angular corners, grooves, or the like which allow formation of nests of impurities. These surfaces can be easily and thoroughly sterilized.

Additional refinements and advantages of the invention are set forth in the dependent claims. These will now be discussed in more detail with reference to the drawings.

Figure 2:
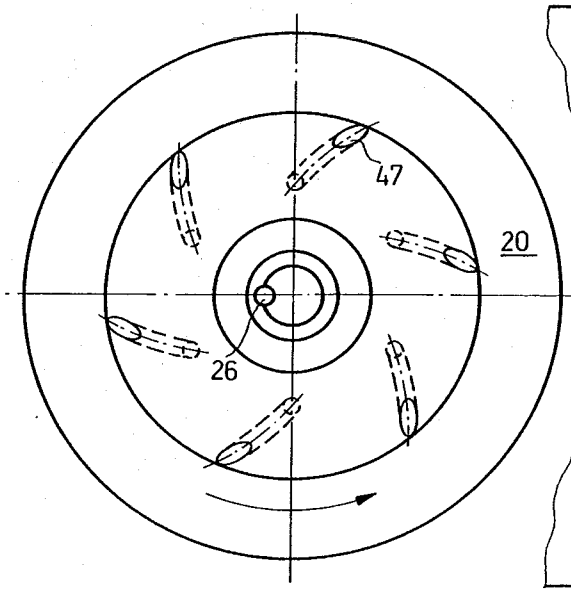
FIG. 2 is a view of a rotor disc from the left in FIG. 1.

The gap-type ball mill shown in FIGS. 1 and 2 is essentially comprised of a mill housing 1 which accommodates three mill units 2 that each comprise a multipart stator 3 and a multipart rotor 4. The rotor 4 spins around the mill axis 5, being driven by an electric motor 6 which preferably is controllable.

The motor 6 is flange mounted to the fixed-mounted mill housing 1. The motor shaft rotationally, rigidly engages a key 8 in the bore 9 formed in the left end (FIG. 1) of the rotor shaft 10. The other end of shaft 10 rests via a journal bearing in an outer cover 12 which closes off the can-shaped mill housing 1 and includes the material inlet 13.

Each of the three mill units 2 is comprised of a stator unit 16 with a first stator disc 17 and a second stator disc 18. These stator discs 17 and 18 form between them a milling space unit 19, in which the rotor disc 20, which is in the form of a friction disc, spins.

The individual rotor discs 20 of the multistage rotor 4 are supported in sequence on the rotor shaft 10 between the shoulder 24 of the shaft and a nut 25 screwed onto a part of the shaft near the journal bearing 11. The hubs 21 of the rotor discs 20 are separated by spacer bushings 23. The bushings 23 can basically be of equal length, but preferably they are stocked in a variety of slightly differing lengths, in order to be able to accurately fix the positions of the rotor discs 20.

Figure 5:
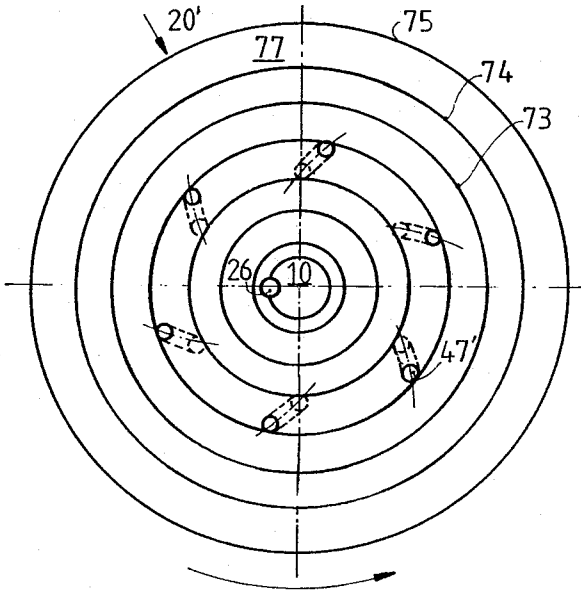
FIG. 5 is an end view of a rotor disc according to FIG. 4, which corresponds essentially to that of FIG. 2.

For torque transmission, individual driving bolts 26 of polygonal cross section shown in FIGS. 2 and 5 are provided which are matched to the length of the hubs 21. The bolts 26 are accommodated in an approximately semi-cylindrical groove 27 which runs longitudinally through the rotor shaft 10. The first stator discs 17 have a central, cone-shaped part 171 at an angle of 60° to the mill axis 5. Inwardly, adjoining the part 171, is an S-shaped part 172, and outwardly is a nearly cylindrical partial flange 173. Each second stator disc 18 has an inner approximately flat part 181 and an outer conical part 182 which is also at a 60° angle to the mill axis 5. The radially innermost and outermost members of each disc 18 have surfaces which face in a radial direction. In these inner and outer regions, the discs 17 and 17 are sealed mutually and against the mill housing 1 by sealing rings 33 and 34 and supporting rings or spacer rings 35. The latter of these serve most importantly as resilient, damping, support elements.

Each rotor disc 20 extends from its hub 21 outward in, first, and approximately flat intermediate part 22, and then in an outer conical ring 28 which is positioned substantially in the middle of the milling space unit 19 between respective conical parts 171 and 182 of the corresponding two stator discs 17 and 18. A pulverization gap 36 of approximately uniform width is formed around the entire rotor disc 20 beyond the hub, forming a "gap loop" 37 around the conical ring 28, which "gap loop" is closed on the radially outer side. The gap loop 37 communicates, via radial communicating gaps 38 and 39 with connecting gaps 40 and 41 and thereby with the ring-shaped end openings or "radial end surfaces" 42 of the stators which are formed by the stator discs 17 and 18 of the individual milling units 2.

The upper ends of the communicating gaps 38 and 39, respectively, are interconnected by at least two ball recycle channels 47 which adjoin the inner surface 46 of the conical ring 28. These channels 47 may also be inclined at c. 60° to the rotor axis 5 or as shown in FIG. 2 they can have a spiral course. In this way with a spiral course, greater centrifugal forces are exerted on heavy particles, particularly on the grinding elements 48 than on the solid particles of the material being pulverized. The solid particles are being conveyed under pump pressure. In order to amplify this effect, the grinding elements 48 are preferably comprised of ceramic material. Alternatively, they can be comprised of specific very heavy stone material. This will enable a regime to be established in which the grinding elements circulate in a loop which is closed by at least two ball recycle channels 47. Thereby the grinding elements remain in the given milling unit.

The separation process can be further influenced by changing an angle, for example, the inclination of the intermediate gap 49 at the inner face of the conical ring 28.

The grinding elements 48 can also be charged to each mill unit separately, through a filling tube 51 disposed in a holding sleeve 52 in the mill housing 1 and disposed in a bore 53 in the ring-shaped flange 173 which bounds the loop 37. Normally, the filling tube 51 is closed off by a plug 54 held in place by a retaining nut 55. A measuring sensor or device 56, for example, for measuring pressure, temperature, viscosity, or the like, of the material being pulverized, can be inserted or mounted in place of the plug 54.

The material inlet 13 and outlet 14 are closed off with respect to the adjoining pulverization gap by means of a frictional gap ring 57 inserted between parts of the stator housing flange member 59, of the outer cover 12, and the respective spacing bushing 23. The frictionally sealed gap structure 58, which is wider in its outer part, prevents loss of grinding elements which for some reason (e.g., in startup) can leave their circulation path in the gap loop 37. In the event of a temporary stoppage of the mill, such grinding elements collect at the bottom of the gap loop, and upon restarting they are reaccelerated outward and thereby are distributed in the mill loop.

Spacing rings 61 can be provided between neighboring stators, whereby the axial distances between neighboring stators as well as between stators and rotors can be modified. As an alternative to the illustrated embodiment with spacing rings 61 and the like, devices for continuously adjusting the spacing by means of screws or the like can be provided. The screws 62 on the outer cover 12 can also be made use of in connection with such adjusting.

Outer cooling spaces 64 and 65 are provided on the longitudinal ends of the mill, and ring-shaped cooling spaces 64 are provided between neighboring mill units 2. These individually communicate with wall cooling spaces 85 which are formed between the wall of the mill housing 1 and the ring-shaped flange 172 of the respective first stator disc 17.

The spacing rings 61 include approximately radial openings for connecting the wall cooling spaces 85 to the coolant circulation loop. Instead of a coolant, another heat transfer medium can be used, e.g., for heating or for optional cooling and/or heating. All the cooling spaces are connected to a cooling center or heat source, e.g., via two manifolds 66 turned 180° with respect to the mill axis 5. In this way the operating temperature can be adjusted as required during the pulverization.

The stator discs 17 and 18 and rotor discs 20 are comprised of sintered ceramic material with high temperature-stability and wear resistance. The pressure resistance of these materials is adequate for the loads experienced. In order to compensate for the tensile stresses developed particularly by centrifugal forces, the rotor discs can be fabricated in the form of prestressed structures, by techniques which are known. Also, the coolant pressure used is much higher than with a comparable cooling apparatus. In this way, the stators are pressed together inwardly from the wall cooling spaces 85, in order to compensate for expansion deformation due to centrifugal forces and the like. The stators can also be mechanically pre-stressed.

In order to keep the apparatus diameter small, it is recommended that two or more, possible as many as five mill units be employed. In this connection, a relatively large number of identical component parts is needed, to enable manufacture in relatively large scale serial production, thereby minimizing costs despite complex technology.

Before startup, if contamination-sensitive materials are being processed (e.g., in the food and pharmaceutical industries, and in biotechnology), the pulverization spaces or pulverization gaps and other surfaces coming into contact with the material being pulverized, and spaces in which the cooling or heating media are passed, should be thoroughly sterilized. First, the surfaces are cleaned, and then usually steamed with a pressure c. 1 bar greater than the usual mill pressure is passed through these spaces. The temperature is then constantly increased to a maximum value of c. 140° C. This maximum is maintained for a time which depends on various operating factors. The specific time is advantageously determined by experiments.

After the motor 6 is started up, material being pulverized is fed continuously to the inlet 13 and flows through the serpentine ring-shaped gap running through the successive mill units, until is passes out of the second frictionally sealed gap 58 to the material exit 14 which is sealed with respect to the motor by means of a slide ring packing 68.

The grinding elements, which can be furnished in a variety of sizes, as a rule 0.3–3 mm, are charged when the mill is not running. As fed, they are classified, with elements of diameter c. 3 mm going to the right or first mill unit, c. 1.5 mm going to the middle unit, and c. 0.8 mm to the left unit. Upon startup, the balls, which initially are piled on the bottom of the gap loop 37, are distributed into the remainder of the ring-shaped gap loop, and are accelerated outward by rotation. They become concentrated in the region of the mill loop, by centrifugal forces. Instead of a single return channel 47, advantageously a plurality of channels 47 uniformly distributed around the perimeter, for example, the inner perimeter of the torus-shaped loop (six, in FIG. 2) are provided, depending on what recirculating rate of the balls is desired for the given material being pulverized.

In the recirculation the grinding elements are constantly pressed against the outer conical ring 28, at the inner surface 46 thereof which is essentially an extension or part of the boundary of the ball return channel(s). This allows a type of high intensity pulverization to be produced whereas in the flow back out of the gap loop 37 and into the intermediate gap 49 the contact forces are reduced. Also, the pulverization process is made more uniform and is completed at lower intensity. There are three substantially independent or even disparate pulverization cycles, for example, one in each mill unit, before the material being pulverized reaches the outlet 14. This enables very fine and particularly uniform dispersions to be produced in a relatively short time.

Figure 3:
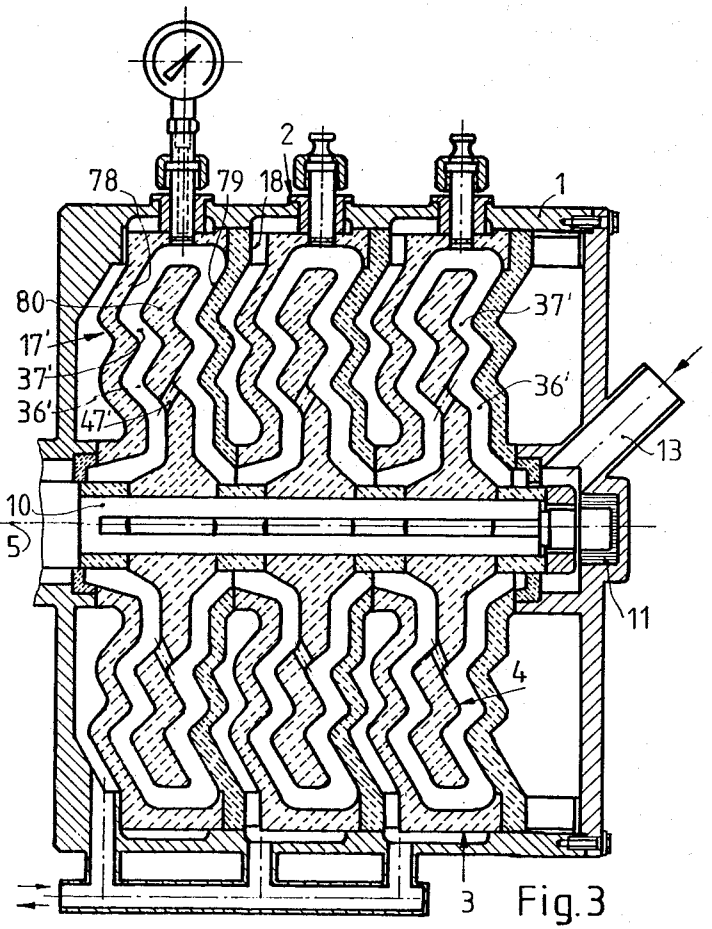
FIG. 3 is an axial cross section, corresponding to that of FIG. 1, for an embodiment with a different pulverization gap configuration.
Figure 4:
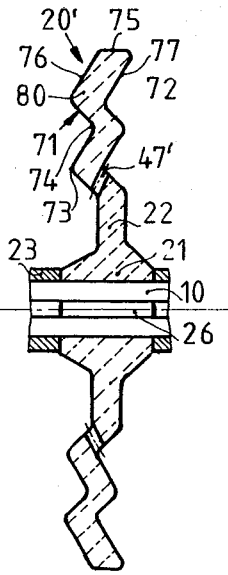
FIG. 4 is a longitudinal cross section through a rotor disc according to FIG. 3.

For the refined embodiment according to FIGS. 3 through 5, the same reference numerals are retained for similar component parts, with modified elements being designated by a prime (') symbol.

The basic difference in this second embodiment in comparison with the first is that in cross section there is an additional corrugation or bend in each flow branch of each pulverization gap 36', particularly in the gap loop 37', wherewith, e.g. at the end faces 71 and 72 of the rotor there are alternating ring-shaped prominences 73 and depressions 74. The end faces and the entire outer region of the rotor disc 20 have a zigzag shape in cross section. Alternatively, they can be wave shaped. To the extend possible, t he mutually associated surfaces, e.g., the end face surfaces 76 and 77 which extend to the outer edge 75, should be at least approximately mutually parallel, and they can also have equal separations. The same applies for the end faces 78 and 79 on the stator discs 17 and 18. The outer conical ring 28 of FIG. 1 is thus converted to a Z-flange 80. The gap loop 37' comprised of the two arms of the pulverization gap 36' has a similar shape to that of the Z-flange.

These two arms of the pulverization gap are connected by ball return channels 47' formed at the lower end of the Z-flange. The mill balls are first introduced in the flow direction, and are deflected sharply outward at the exit of the return channel 47', so that during operation they remain concentrated in their respective gap loops 37', i.e. in the two outer segments of the gap loop arms. The ball return channels 47' and the other parts and configurations not mentioned are the same as in FIGS. 1 and 2, and hence need not be described in detail with respect to the second embodiment.

The embodiments illustrated can be varied in numerous ways within the scope of the invention. Thus, the pulverization gap loops 37, in particular bounded by conical surfaces with straight wall lines in cross section, can instead have concave and convex curved (in cross section) surfaces or the like, so that the loop will have a roughly ellipse-shaped cross section. The angles between the gap loop wall and the mill axis can be chosen equal or unequal, and the rotor discs can form a rotationally rigid interlock over the entire transverse perimeter of the rotor shaft. This interlock may have a polygonal, preferably triangular, cross section, with rounded corners and side surfaces curved transversely to the rotor axis.

I claim:

1. A gap-type ball mill for continuous pulverization particularly breakdown of microorganisms, and dispersions of solids in a liquid, comprising:

(a) stator discs removably mounted in a mill housing, said stator discs being fixed at their outer edges;

(b) said stator discs being matched, at least in pairs to form a stator unit which extends generally radially and includes a rotationally symmetrical pulverization space unit;

(c) a rotor shaft connected to rotary drive and extending centrally through said stator unit and being at least indirectly rotationally-mounted at one end in said mill housing;

(d) said rotor shaft bears at least one easily replaceably rotor disc which, with two stator discs, forms a pulverization gap in said pulverization unit;

(e) the rotor disc extends generally radially outward from a longitudinal mill axis and in axial cross section forms a gap loop which is closed to the exterior; and (f) said gap loop is short-circuited by preferably at least two ball return channels which extend radially outward from said mill axis and serve as centrifugal guiding structures.

2. The gap-type ball mill according to claim 1 wherein a plurality of mill units, each comprised of stator unit and a rotor disc, is disposed sequentially along said mill axis, where by a continuously connected, multistage pulverization gap which is serpentine in cross section is formed between a material inlet and a material outlet.

3. The gap-type ball mill according to claim 1 wherein said stator discs having said outer edge in said mill housing and said rotor disc, having an inner edge against said rotor shaft, are fixed with respect to axial movement.

4. The gap-type ball mill according to claim 3 wherein spacer bushings for setting a width of said pulverization gap are inserted on said rotor shaft between said rotor discs.

5. The gap-type ball mill according to claim 4 wherein said spacing bushings are mutually sealed and are sealed as against the rotor shaft.

6. The gap-type ball mill according to claim 1 wherein each stator disc is bounded on at least one side by a cooling space in which a heat exchange medium is circulated.

7. The gap-type ball mill according to claim 6 wherein at least one ring-shaped wall cooling space is provided between the radial outer surface of the stator and the inner surface of the mill housing.

8. A gap-type ball mill according to claim 7 wherein each mill unit is provided with a first stator disc with an outer ring-shaped flange, which is optionally integral with the disc, wherewith a flange forms an inner boundary of a ring-shaped wall-disposed cooling space, and is sealed by at least two ring seals with respect to a second stator disc which latter disc serves as a cover for said milling space unit.

9. The gap-type ball mill according to claim 7 wherein pressure in at least the ring-shaped wall-disposed cooling space, is at least 1 bar greater than pressure in said pulverization gap, and preferably amounts of 2 to 3 bar.

10. The gap-type ball mill according to claim 1 wherein each pulverization gap in a mill unit has, in a region close around the mill shaft, two oppositely directed connecting gaps, each ending in a generally radial end opening and leading interiorly in the mill unit to radially outwardly extending communicating gaps which in turn lead to the pulverization gap loop which is provided with one or more ball return channels.

11. The gap-type ball mill according to claim 33 wherein each ball return channel forms an angle of 50° to 67° with said mill axis, and merges into the corresponding generally radial communicating gap at the turning locus of a short inner loop part.

12. The gap-type ball mill according to claim 1 wherein said pulverization gap loops are, over most of their extend, inclined with respect to said mill axis and are formed by at least approximately parallel, preferably obtuse-angled, cone shaped gaps.

13. The gap-type ball mill according to claim 12 wherein the pulverization gap loops have a corrugated or zigzag shape, comprised of corresponding concentric ring-shaped depressions and prominences in the surfaces of the stator discs and rotor discs.

14. The gap-type ball mill according to claim 15 wherein each ball return channel has a boundary which is in part an extension of a wall surface of an inner gap segment, and is curved in a spiral configuration of a centrifugal pump channel.

15. The gap-type ball mill according to claim 1 wherein said ball return channels are disposed in said gap loops such that grinding elements coming from an exit of a given return channel enter into the outwardly directed flow of material in a direction of entry which is at least approximately tangential, but the grinding elements entering an inlet of a given return channel from the inwardly directed flow of material are abruptly accelerated back radially outwardly.

16. The gap-type ball mill according to claim 1 wherein for retaining of said grinding elements at said material inlet and material outlet, passages are closed off by respective frictionally sealing gap rings which form a frictionally sealed gap.

17. The gap-type ball mill according to claim 16 wherein retaining devices for grinding elements are provided in said pulverization gap, between neighboring mill units, which retaining devices are also frictionally sealing gap rings.

18. The gap-type ball mill according to claim 1 wherein each pulverization space unit has a penetrating filling-channel for said balls, which is sealed by a wall cooling-space.

19. The gap-type ball mill according to claim 18 wherein said ball filling channel has a filling tube which is replaceable and is disposed in an insert bushing sealed against said mill housing and against the ring-shaped flange.

20. The gap-type ball mill according to claim 18 wherein said filling tube is closed by a removable plug, by a measuring sensor for operating-parameters.

21. The gap-type ball mill according to claim 1 wherein at least said rotor disc and said stator discs are comprised of sintered material.

22. The gap-type ball mill according to claim 21 wherein at least said rotor disc is comprised of ceramic material with wear-resistant granular base material.

23. The gap-type ball mill according to claim 21 wherein said rotor discs each have a noncircular through-penetrating hub opening which is free of vertexes or ridges, with the disc being mounted on the similarly noncircular rotor shaft.

24. The gap-type ball mill according to claim 23 wherein said transverse engaging cross section of the rotor disc with said rotor shaft is based on a shape of a triangle.

* * * * *